US006371210B1

(12) United States Patent
Bode et al.

(10) Patent No.: US 6,371,210 B1
(45) Date of Patent: Apr. 16, 2002

(54) FLOW CONTROL APPARATUS FOR USE IN A WELLBORE

(75) Inventors: Jeffrey Bode, The Woodlands; Eric Lauritzen, Kingwood, both of TX (US)

(73) Assignee: Weatherford/Lamb, Inc., Houston, TX (US)

( * ) Notice: Subject to any disclaimer, the term of this patent is extended or adjusted under 35 U.S.C. 154(b) by 0 days.

(21) Appl. No.: 09/685,368

(22) Filed: Oct. 10, 2000

(51) Int. Cl.[7] ..... E21B 43/08

(52) U.S. Cl. ..... 166/370; 166/233; 166/236

(58) Field of Search ..... 166/233, 236, 166/278, 228, 51, 133, 242.1, 305.1, 370

(56) References Cited

U.S. PATENT DOCUMENTS

| | | | | |
|---|---|---|---|---|
| 3,739,845 A | | 6/1973 | Berry et al. | 166/65 R |
| 3,951,338 A | | 4/1976 | Genna | 236/93 A |
| 4,440,218 A | * | 4/1984 | Farley | 166/51 |
| 4,733,723 A | * | 3/1988 | Callegari, Sr. | 166/51 |
| 4,936,386 A | | 6/1990 | Colangelo | 166/292 |
| 5,419,394 A | * | 5/1995 | Jones | 166/51 |
| 5,509,757 A | * | 4/1996 | Croy | 405/128 |
| 5,609,204 A | | 3/1997 | Rebardi et al. | 166/51 |
| 5,641,023 A | * | 6/1997 | Ross et al. | 166/386 |
| 5,662,165 A | | 9/1997 | Tubel et al. | 166/250.01 |
| 5,881,809 A | * | 3/1999 | Gillespie et al. | 166/233 |

FOREIGN PATENT DOCUMENTS

| | | |
|---|---|---|
| WO | WO 00/45031 | 8/2000 |

OTHER PUBLICATIONS

PCT International Search Report for International Application PCT/US00/02420 mailed May 11, 2000.

* cited by examiner

*Primary Examiner*—Frank Tsay
(74) *Attorney, Agent, or Firm*—Moser, Patterson & Sheridan, L.L.P.

(57) ABSTRACT

The present invention provides an apparatus for use in a wellbore to compensate for pressure differentials between fluid in the wellbore and fluid in an oil bearing formation therearound. In one aspect of the invention, an apparatus is provided for insertion in a string of screened tubulars in a horizontal wellbore. The device includes an inner tubular body portion having apertures in the wall thereof for passing oil, an outer tubular body and a pathway therebetween permitting oil from a formation to migrate into the inner body. Disposed around the inner body is an axially movable member to selectively cover and expose the apertures of the inner body, thereby permitting fluid to flow therethough.

22 Claims, 12 Drawing Sheets

FLOW CONTROL APPARATUS FOR USE IN A WELLBORE

BACKGROUND OF THE INVENTION

1. Field of the Invention

The invention relates to the control of fluid flow into a wellbore. More particularly, the invention relates to a flow control apparatus that compensates for pressure differentials along a wellbore.

2. Background of the Related Art

In hydrocarbon wells, horizontal wellbores are formed at a predetermined depth to more completely and effectively reach formations bearing oil or other hydrocarbons in the earth. Typically and as shown in FIG. 1, a vertical wellbore 102 is formed from the surface of a well 100 and thereafter, using some means of directional drilling like a diverter, the wellbore is extended along a horizontal path. Because the hydrocarbon bearing formations can be hundreds of feet across, these horizontal wellbores 104 are sometimes equipped with long sections of screened tubing 106 which consists of tubing having apertures therethough and covered with screened walls, leaving the interior of the tubing open to the inflow of filtered oil.

Along the length of a horizontal wellbore 104, a pressure drop occurs between the toe 108, or end of the wellbore and the heel portion 110 thereof due primarily to friction looses in fluid traveling through the wellbore. Over time, the lower pressure of the fluid at the heel of the wellbore 104 causes a correspondingly lower fluid pressure in the formation adjacent the heel. The result is a "coning" effect whereby fluid in the formation tends to migrate toward the heel 110 of the wellbore, decreasing the efficiency of production over the length of the horizontal wellbore. The path of fluid in such a condition is illustrated by arrows 101 in FIG. 1.

In an attempt to equalize the fluid pressure across a horizontal wellbore, various potential solutions have been developed. One example is the EQUALIZER™ production management system manufactured and sold by Baker Oil Tools of Houston, Tex. The EQUALIZER™ device incorporates a helical channel as a restrictor element in the inflow control mechanism of the device. The helical channel surrounds the inner bore of the device and restricts oil to impose a more equal distribution of fluid along the entire horizontal wellbore. However, such an apparatus can only be adjusted at the well surface and thereafter, cannot be re-adjusted to account for dynamic changes in fluid pressure once the device is inserted into a wellbore. Therefore, an operator must make assumptions as to the well conditions and pressure differentials that will be encountered in the reservoir and preset the helical channel tolerances according to the assumptions. Erroneous data used to predict conditions and changes in the fluid dynamics during downhole use can render the device ineffective.

A variation of the same problem arises in the operation of gas injection wells. Under certain conditions, it is necessary to provide artificial forces to encourage oil or other hydrocarbons into a wellbore. One such method includes the injection of gas from a separate wellbore to urge the oil in the formation in the direction of the production wellbore. While the method is effective in directing oil, the injection gas itself tends to enter parts of the production wellbore as the oil from the formation is depleted. In these instances, the gas is drawn to the heel of the horizontal wellbore by the same pressure differential acting upon the oil. Producing injection gas in a hydrocarbon well is undesirable and it would be advantageous to prevent the migration of injection gas into the wellbore.

There is a need therefore, for a flow control apparatus for downhole use in a wellbore that compensates for the dynamic changes and differences in fluid pressure along the length of the wellbore. There is a further need, for a flow control apparatus for use in a wellbore that is self-regulating and self-adjusts for changes in pressure differentials between an oil bearing formation and the interior of the apparatus. There is yet a further need for a flow control apparatus that prevents the introduction of unwanted gasses and fluids into a wellbore but allows the passage of oil therethrough. There is yet a further need for a flow control apparatus that will prevent the migration of unwanted fluids into a wellbore after the oil in a formation therearound is depleted. There is still a further need for a flow control apparatus that can be controlled remotely based upon well conditions in a wellbore or in the formation therearound.

SUMMARY OF THE INVENTION

The present invention provides an apparatus for use in a hydrocarbon producing wellbore to compensate for pressure differentials between fluid in the wellbore and fluid in an oil bearing formation therearound. In one aspect of the invention, a perforated inner tube is surrounded by at least one axially movable member that moves in relation to pressure differentials between fluid inside and outside of the apparatus. The movable member selectively exposes and covers the perforations of the inner tube to pass or choke fluid moving into the apparatus from the wellbore. In another aspect of the invention, an apparatus is provided for insertion in a string of screened tubing in a horizontal wellbore. The apparatus includes an inner tubular body portion having apertures in the wall thereof for passing oil, an outer tubular body and a pathway therebetween permitting oil from a formation to migrate into the inner body. Disposed around the inner body is an annular sleeve having apertures formed therethrough, the apertures constructed and arranged to align with the apertures of the inner body, thereby permitting fluid to flow therethough. In one embodiment, the sleeve member is spring biased on the inner body, and includes a piston surface acted upon by fluid entering an annular area between the annular sleeve and the outer body. In the presence of a pressure differential between the fluid in the formation and the fluid inside the apparatus, the apparatus is designed to restrict the flow of oil into the wellbore. Specifically, the piston surface is deflected by a mass flow rate brought about by a pressure differential. As the piston is deflected, the apertures of the body and the sleeve become increasingly misaligned, preventing most inflow of fluid into the body when the piston is completely actuated. The flow of fluid into the apparatus therefore, is inversely related to the pressure differential between the inside and outside of the apparatus. In another aspect of the invention, more than one apparatus is placed in series in a wellbore to compensate for pressure differential over a predetermined length of the wellbore. In another aspect of the invention, the apparatus is at least partially controlled by regulating and manipulating the pressure in a formation that is acted upon by an injection gas.

BRIEF DESCRIPTION OF THE DRAWINGS

So that the manner in which the above recited features, advantages and objects of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

To facilitate understanding, identical reference numerals have been used, where possible, to designate identical elements that are common to the Figures.

DETAILED DESCRIPTION OF THE PREFERRED EMBODIMENT

Figure 1:
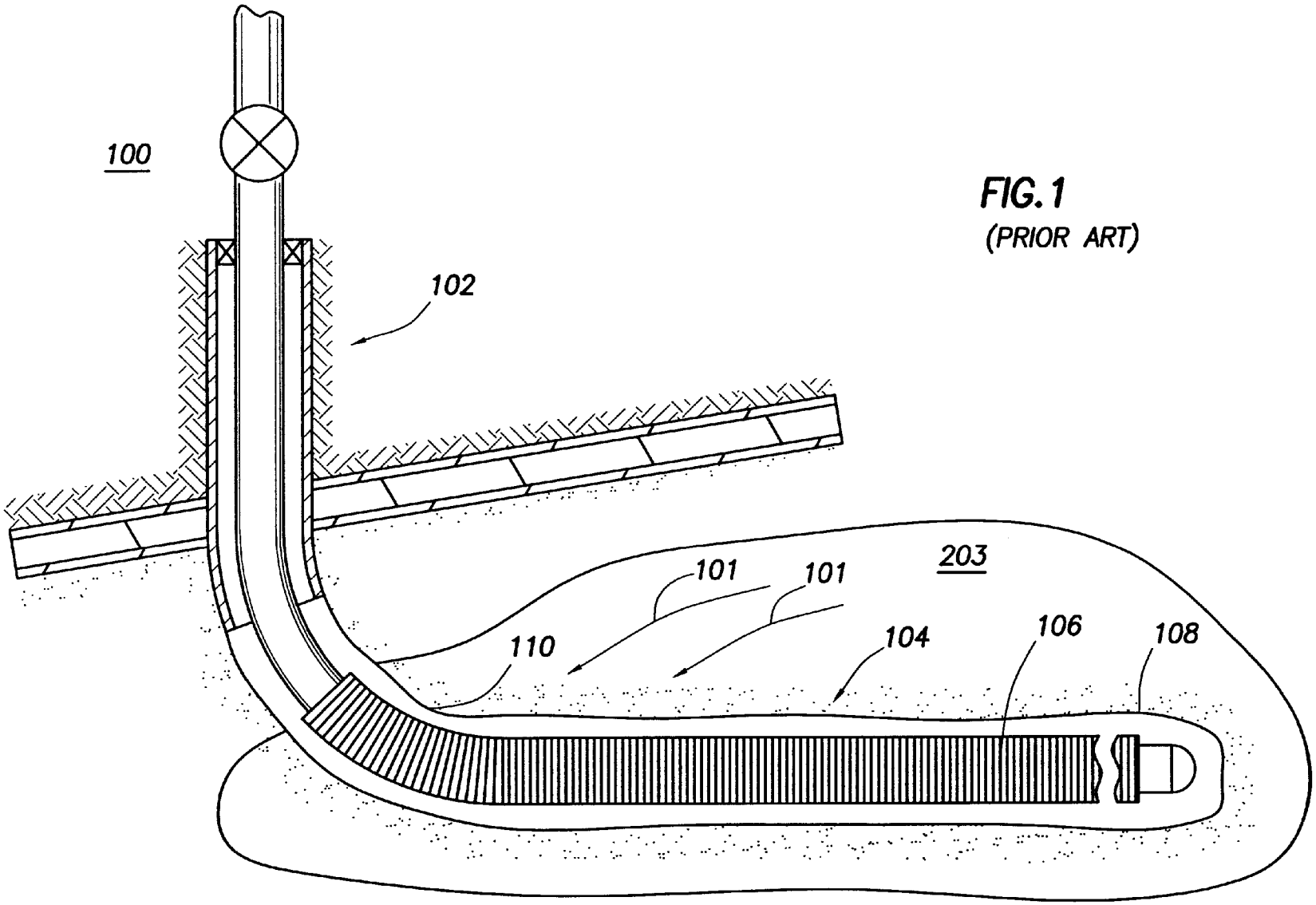
FIG. 1 (PRIOR ART)
FIG. 1 depicts a partial cross-sectional view of a prior art vertical and horizontal hydrocarbon wellbore.
Figure 2:
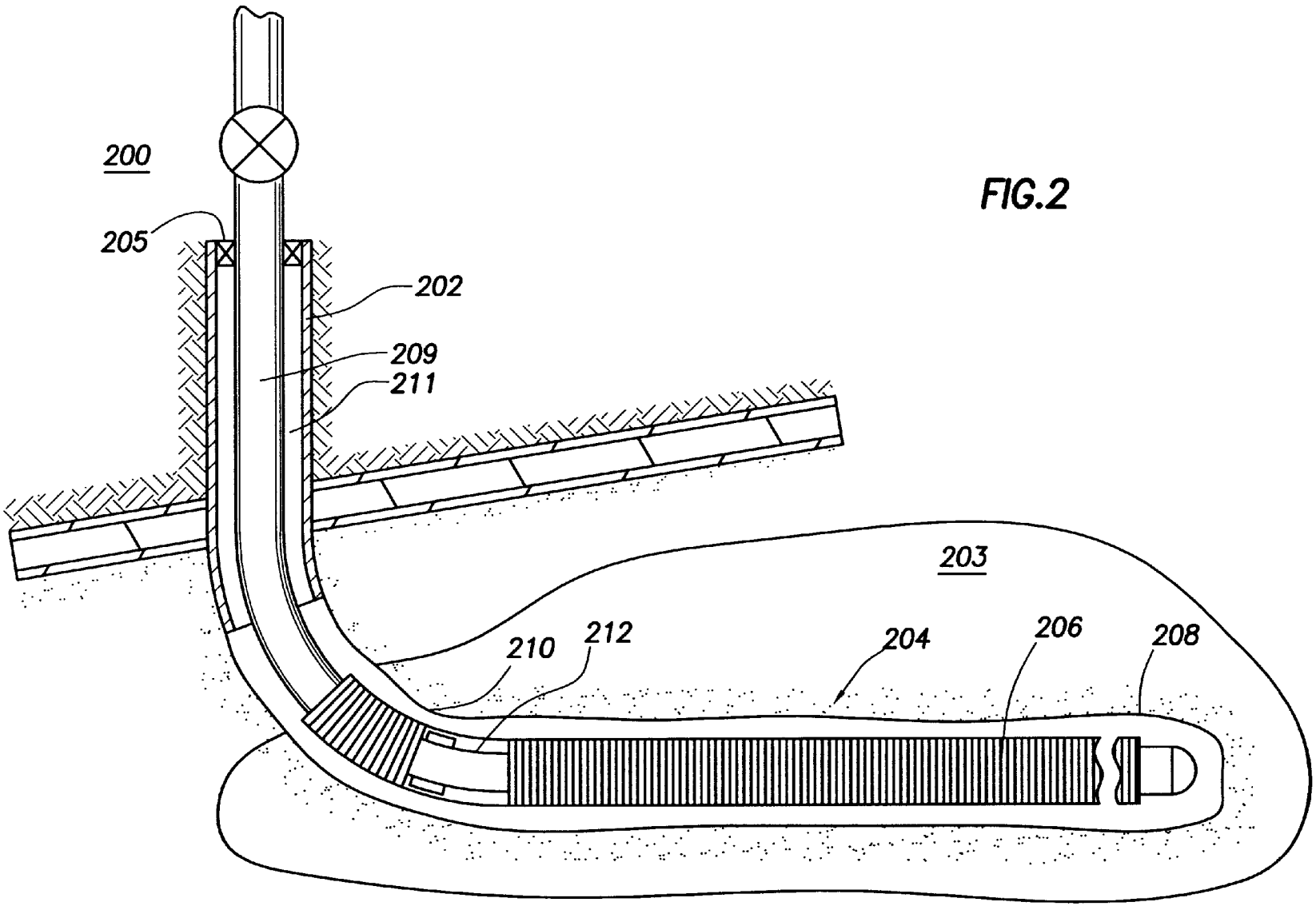
FIG. 2 is a partial cross-sectional view of the apparatus of the subject invention in a horizontal wellbore.

FIG. 2 depicts a cross-sectional view of a well 200 having a flow control apparatus 212 located therein. Specifically, an apparatus 212 for controlling the flow of oil or some other hydrocarbon from an underground reservoir 203 into a wellbore 202 is depicted. The well 200 includes a cased, vertical wellbore 202 and an uncased, horizontal wellbore 204. Production tubing 209 for transporting oil to the surface of the well is disposed within the vertical wellbore 202 and extends from the surface of the well 200 through a packing member 205 that seals an annular area 211 around the tubing and isolates the wellbore therebelow. A horizontal wellbore 208 includes a section of screened tubing 206. The screened tubing 206 continues along the horizontal wellbore 204 to a toe 208 thereof. The apparatus 212 is attached to the screened tubing 206 near the heel 210 of the horizontal wellbore 204.

Figure 3:
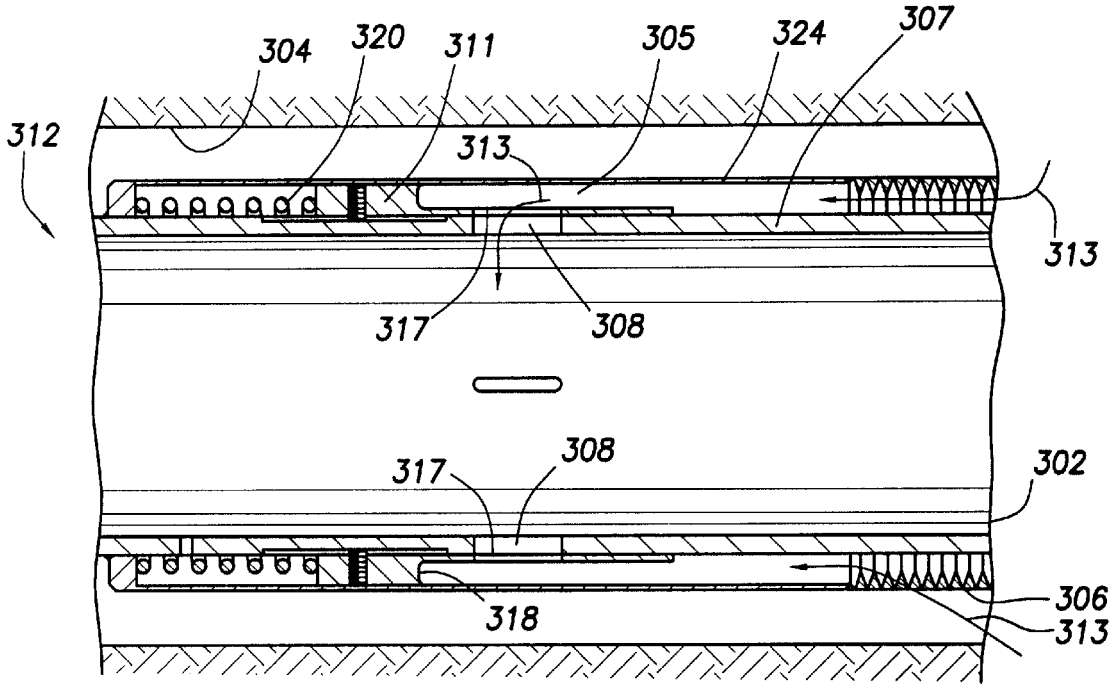
FIG. 3 is a more detailed cross-sectional view of the apparatus showing an annular sleeve therein in a biased-open position relative to the inner body of the apparatus.

FIG. 3 is a more detailed view of an apparatus 312 in an uncased, horizontal wellbore 304. In the embodiment of FIG. 3, the flow control apparatus 312 is a two-position apparatus with a first position allowing the unrestricted inflow of oil and a second position restricting the inflow of oil. The apparatus is additionally designed to assume any number of positions between the first and second positions thereby providing an infinitely adjustable restriction to the inflow of oil into the wellbore. While the second position in the embodiment shown does not completely restrict the flow of fluid into the apparatus, it will be understood by those skilled in the art that the apparatus could be designed to completely restrict the passage of fluid.

The apparatus includes an inner tubular body 307 having an outer tubular body 324 disposed therearound. Disposed in an annular area 305 between the inner 306 and outer 324 bodies is an axially slidable sleeve member 311 which is biased in a first position relative to the inner body 306 by a spring 320 or other biasing member. Apertures 317 formed in the sleeve 311 are aligned with mating apertures 308 formed in the inner body 306 to allow oil to pass from the wellbore into the apparatus 312. In the embodiment shown in FIG. 3, the apparatus 312 is integrally formed at an end of a joint of screened tubing 306. Proximate a first end 302 of the flow control apparatus 312, the screened tubing 306 is un-perforated and fluid passing through the screen is directed into annular area 305 of the apparatus 312. The fluid flow into the apparatus is illustrated by arrows 313. A piston surface 318 is formed on the sleeve 311 and is constructed and arranged to cause the sleeve 311 to become deflected and to move axially in relation to the inner body when acted upon by a fluid with sufficient momentum and mass to overcome the resistive force of the spring 320. Specifically, the spring 320 is selected whereby a mass flow rate created by a pressure differential will result in a fluid momentum adequate to deflect the sleeve, thereby shifting the apparatus from the first fully opened position to a position wherein the inflow of fluid into the apparatus is at least partially restricted.

Figure 4:
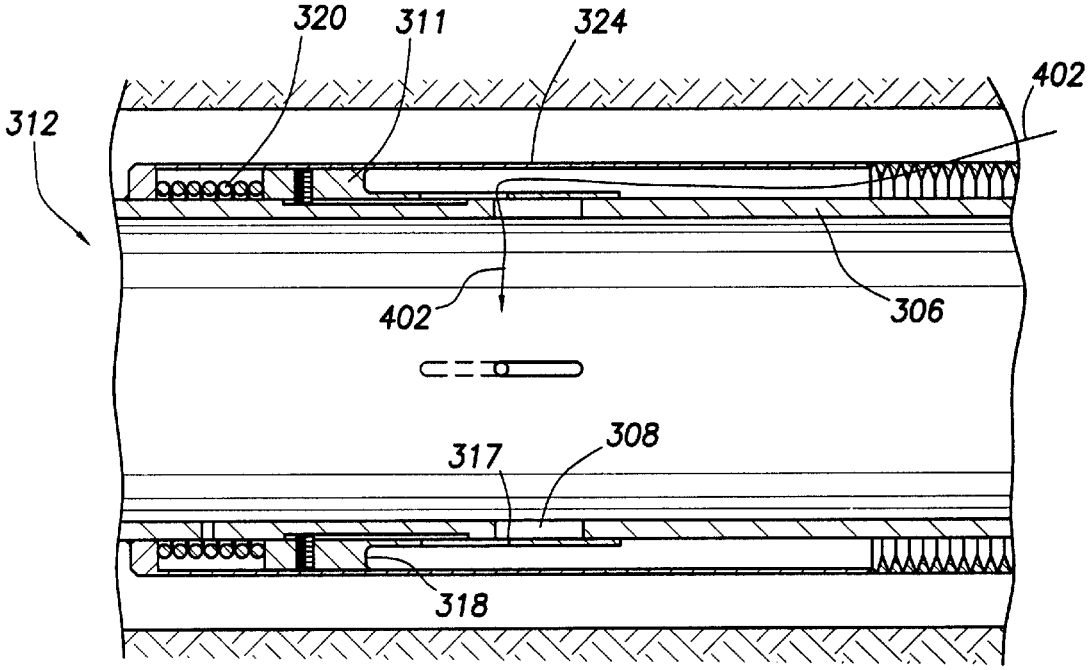
FIG. 4 is a cross-sectional view of the apparatus showing the annular sleeve in a partially closed position relative to the inner body of the apparatus.

In FIG. 3, the apertures 308 formed in the wall of the inner member and the apertures 317 formed in the sleeve 311 are aligned, allowing an open path of fluid into the interior of the apparatus 212 from the wellbore therearound. The position of the sleeve in FIG. 3 is indicative of little or no pressure differential between the exterior and interior of the apparatus 212. In the presence of a predetermined pressure differential, the sleeve 311 is deflected by a mass flow rate of fluid proportional to the difference in pressure between the interior and exterior of apparatus 312. As the sleeve 311 is moved from the first position, the flow of fluid into the apparatus is reduced, thereby compensating for a pressure differential by creating an area of restricted flow into the wellbore. FIG. 4 is a cross-sectional view of the apparatus 312 showing the sleeve 311 in a shifted position relative to the inner body 306. As illustrated in the Figure, fluid acting upon piston surface 318 of sleeve 311 has compressed spring 320 and shifted the sleeve to a second position. In the position shown in FIG. 4, he apertures 317 in the sleeve 311 and the apertures 308 of the inner body 306 are partially misaligned. This condition constricts the flow of fluid into the apparatus. The constricted flow path is illustrated by arrows 402.

Figure 5:
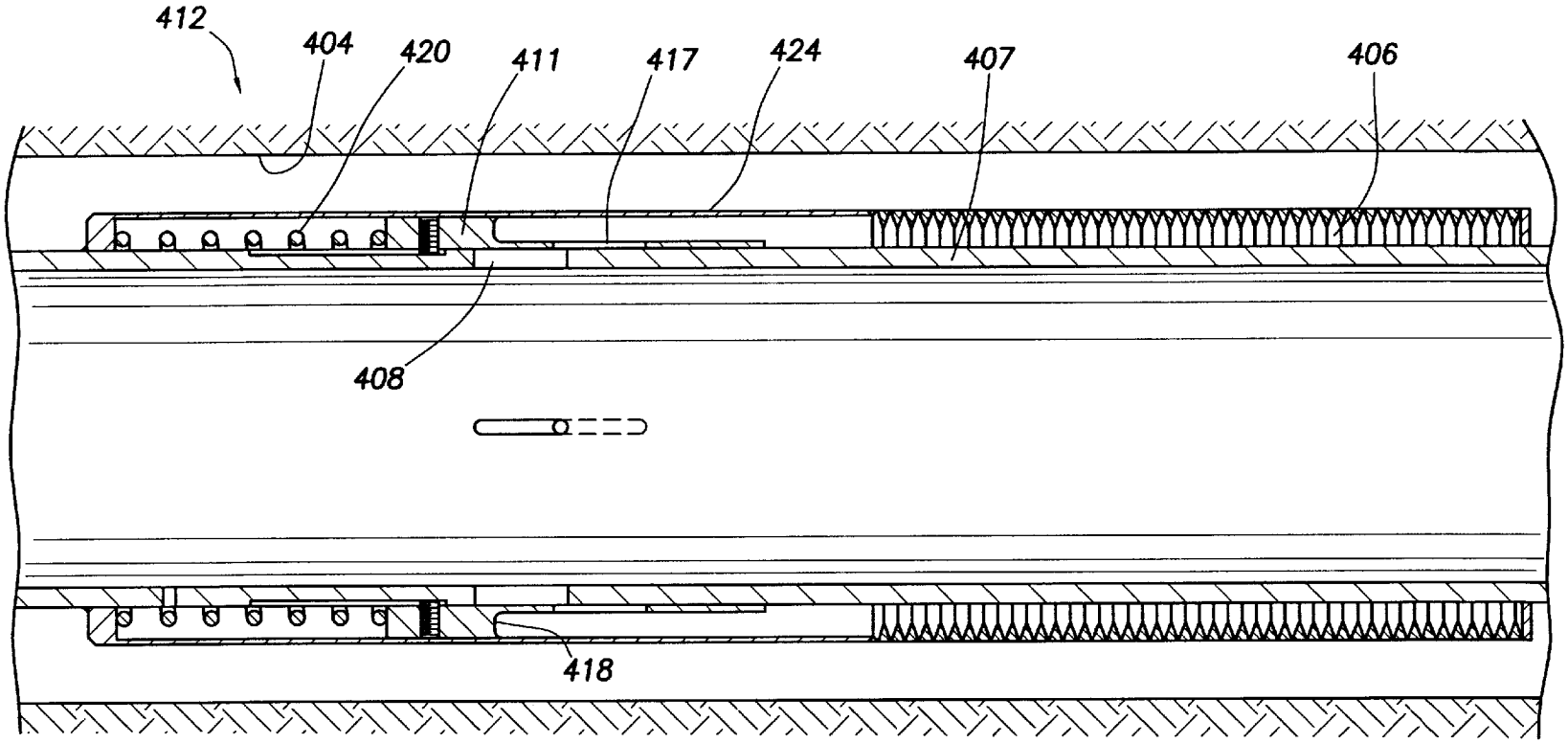
FIG. 5 illustrates an alternative embodiment of the invention with the sleeve portion in a first or partially closed position.

FIG. 5 depicts an alternative embodiment of the invention including an apparatus 412 for use in wellbores of gas injection wells where, for example gas is provided from another wellbore near the producing wellbore 404. Typically, the secondary wellbore (not shown) is drilled to the top of the formation and gas or some other injection material is injected therein. Injection material is typically an inert, environmentally safe material that will not unduly degrade the quality of oil during production. For example the injection material could be selected from the group consisting of water, steam and gas recovered from another portion of the formation. Other types of injection materials are known to those skilled in the art and are considered within the scope of this application.

Figure 6:
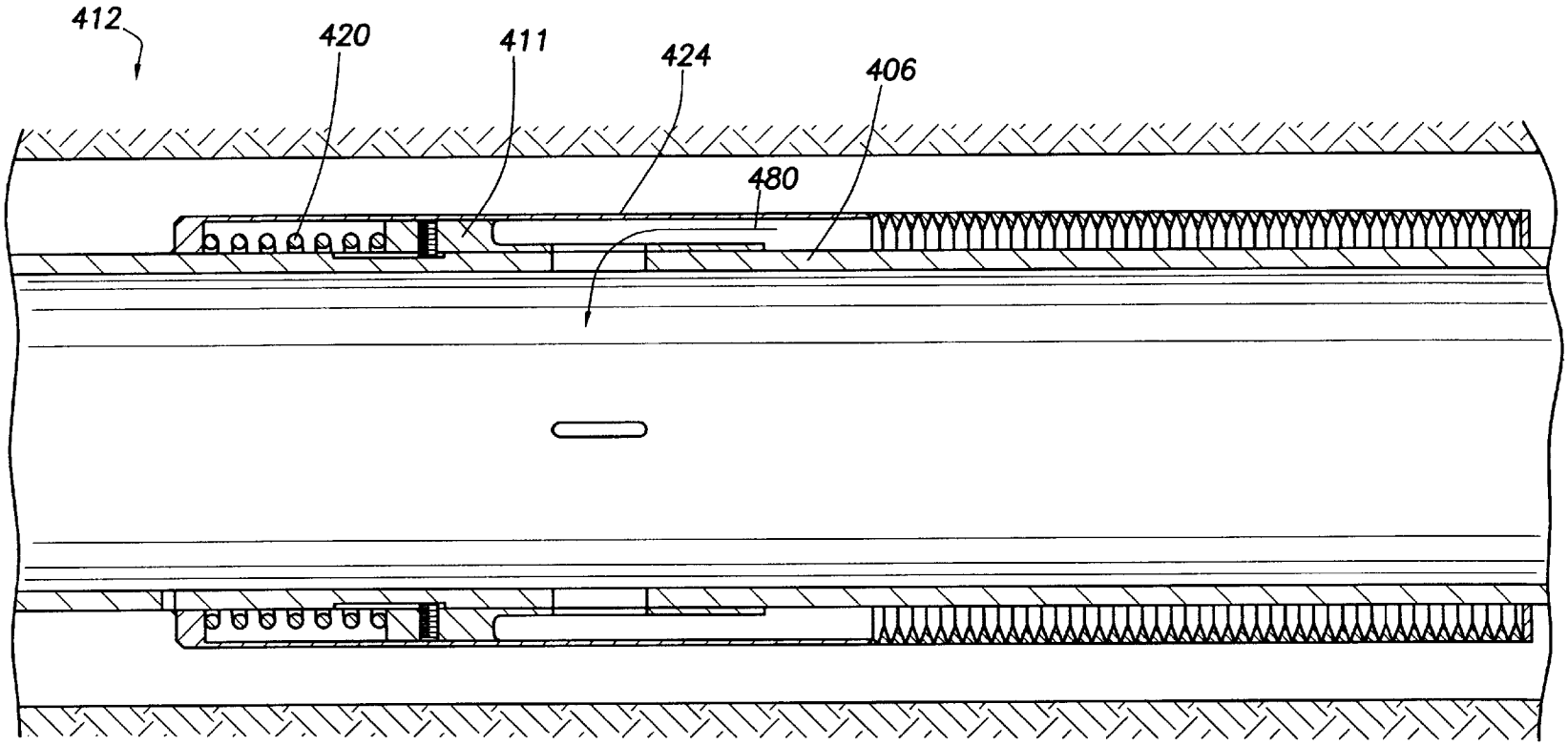
FIG. 6 illustrates the apparatus of FIG. 5, with the sleeve portion shown in a second or open position.

In the embodiment of FIG. 5, all components of the apparatus 412 are essentially identical to those described above with respect to FIGS. 2–4 with the addition of a third position of the sleeve 411 with respect to the inner body 406 of the apparatus. Specifically, the sleeve 411 and spring 420 are designed to restrict the inflow of oil in a first position and a third position and to permit the inflow of oil in a second, center position. FIG. 5 illustrates the apparatus 412 with the sleeve in a first position whereby the inflow into the apparatus 412 is restricted due to a misalignment of apertures in the sleeve 411 and the inner body 408. Since it is undesirable to introduce an injection material like gas into the wellbore, the apparatus 412 is designed to restrict the flow of any material into the wellbore when that material has a mass flow rate lower than that of oil. In other words, since the gas injection material has a lower mass flow rate than oil, the presence of gas will not deflect the piston surface 418 of the sleeve 411 in order to shift the apparatus 412 to the center position illustrated in FIG. 6. In the presence of oil, with its higher mass flow rate however, the apparatus 412 will allow the oil to pass therethrough as the oil causes the sleeve 411 to move to a central, or opened position within the apparatus. FIG. 6 illustrates the apparatus 412 in its center or opened position. The action of oil on the piston surface 418 of the sleeve 411 has caused the sleeve to move axially and partially compress spring 420 disposed between the sleeve 411 and the outer member 424. The flow of oil into the apparatus is illustrated by arrows 480.

Figure 7:
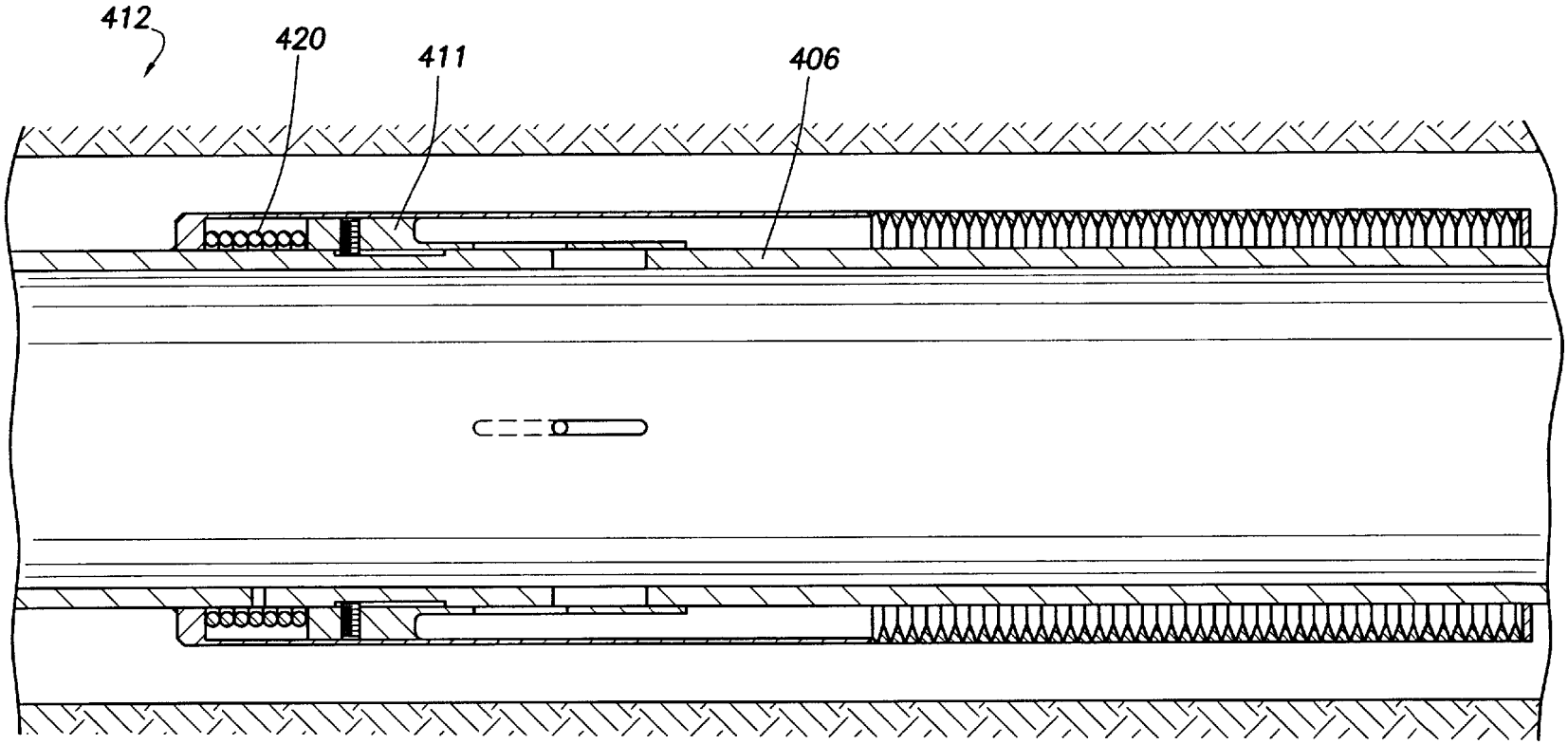
FIG. 7 illustrates the apparatus of FIG. 5, with the sleeve portion shown in a third or partially closed position.

In the presence of a pressure differential between oil on the exterior and interior of the apparatus, the sleeve 411 of the apparatus 412 will move toward a third or partially closed position, thereby restricting the flow of the fluid into the apparatus. FIG. 7 illustrates the apparatus 412 in the third position. Spring 420 is almost completely compressed as fluid momentum has acted upon piston surface 418 of sleeve 411, causing the sleeve to move axially in the direction of the spring 420. In the position illustrated in FIG. 7, the apparatus has compensated for a pressure differential by partially restricting the inflow of oil into the apparatus.

Figure 8:
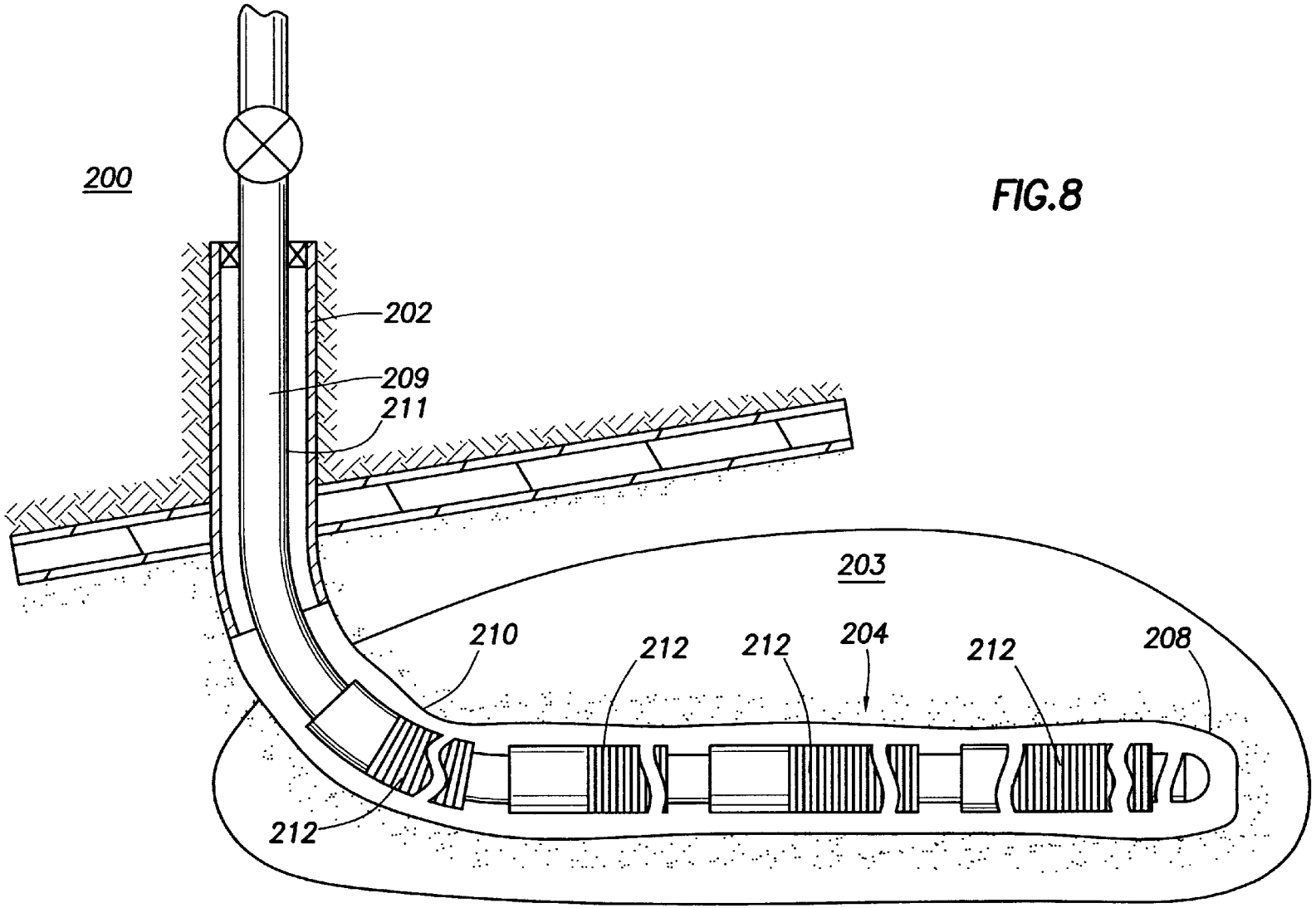
FIG. 8 depicts multiple flow control apparatus according to the invention placed in series along a horizontal wellbore.

From the basic designs seen and described herein, the apparatus of the present invention can be expanded upon in various embodiments to address wellbore conditions relating to differences in pressure along a wellbore or the presence of an unwanted gas or fluid near a wellbore. For example, FIG. 8 depicts a number of apparatus 212 linked in series along a horizontal wellbore 204 from the heel end 210 towards the toe end 208. Having multiple apparatus 212 along the wellbore 204 compensates for differing and increasing/decreasing pressure differentials along the wellbore. In this multi-apparatus embodiment, the sleeves in each subsequent apparatus would typically be shifted and closed to a lesser extent as the pressure differential along the horizontal wellbore decreases in the direction of the toe portion of the wellbore.

Figure 9:
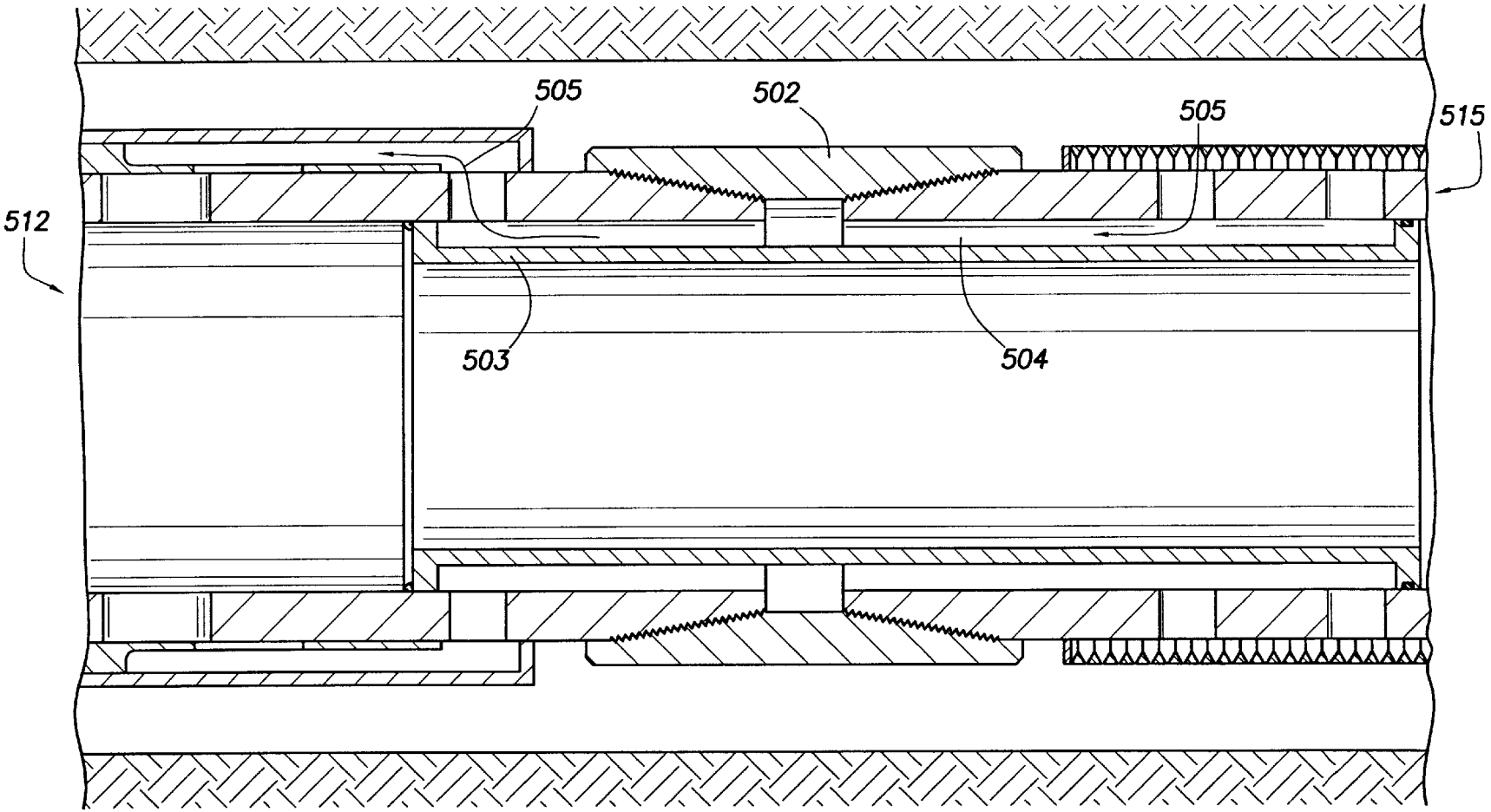
FIG. 9 depicts an embodiment of the invention wherein the apparatus is connectable to a standard section of screened tubular.

FIG. 9 shows an embodiment of the invention wherein the apparatus 512 is a separate unit and can be installed on the end of a standard piece of screened tubing 515. In the embodiment of FIG. 9, apparatus 512 is linked to the screened tubing 515 via a threaded coupler 502. The apparatus 512 is provided with a stab portion 503 that is constructed and arranged to be received in the interior of the screened tubing 515, creating an annular area 504 which is sealed at a first end an provides a fluid path into the apparatus 512 at a second end. The apparatus 512 is then affixed to the screened tubing 515 with coupler 502. In use, the oil entering the screened tubing 515 is directed into the annular area 504 and then into the apparatus 512. The path of fluid into the apparatus 512 is depicted by arrows 505.

In addition to actuating the sleeve of the apparatus through fluid momentum, the apparatus can utilize remote means of actuation, including hydraulic and electrical means. For example, the apparatus can be controlled from the surface of the well via a hydraulic line in fluid contact with the piston surface of the apparatus. In this manner, the position of the piston can be influenced by an operator at the surface of the well due to conditions or needs not directly related to mass flow rate of a fluid into the apparatus. The hydraulic line can be utilize as the sole actuating means for the apparatus or can be used in conjunction with a biasing member, like a spring. In another example, the apparatus is actuated by electric means through the use of a solenoid attached to a pressure sensing device. In this example, fluid pressure inside and outside of the apparatus is measured and a pressure differential therebetween calculated. The pressure differential is compared to a stored value and a solenoid thereafter adjusts the position of the sleeve to open or close the apparatus to the flow of fluid therein. The electrical components making up this embodiment are well known to those skilled in the art.

In a gas injection well, the position of the sleeve within the flow control apparatus can be manipulated by changing the flow rate of gas injected into an adjacent wellbore or wellbores. For example, one or more flow control apparatus according to the invention may be installed along a horizontal wellbore to compensate for pressure differentials expected along the wellbore near the heel portion. In a gas injection operation, the formation around the horizontal wellbore is influenced by an injection well pumping for example, 2000 cubic meters of gas into the formation each day. If the apparatus along the wellbore do not assume the ideal position to compensate for pressure differentials, the formation pressure can be increased or decreased to urge the apparatus to the desired position. By increasing the flow rate of gas pumped into the adjacent wellbore to, for example, 2500 cubic meters per day, the formation pressure can be increased with a directly related increase in flow velocity of fluid into the apparatus. A sufficiently increased mass flow rate will cause the flow control apparatus to move to a more restricted position, thereby compensating for the pressure differential between the formation and the interior of the horizontal wellbore. Alternatively, the amount of gas injected into a formation can be reduced, causing the flow control apparatus along a horizontal wellbore to move towards an unactuated position.

There follows some alternate embodiments of apparatus, all of which are within the purview of the invention. In each case the apparatus controls the flow of fluid into a wellbore. While not necessarily depicted in all of the Figures, each embodiment can be arranged to allow fluid flow into the apparatus to be reduced, increased or shut off depending upon mass flow rate of fluid around the apparatus.

Figure 10:
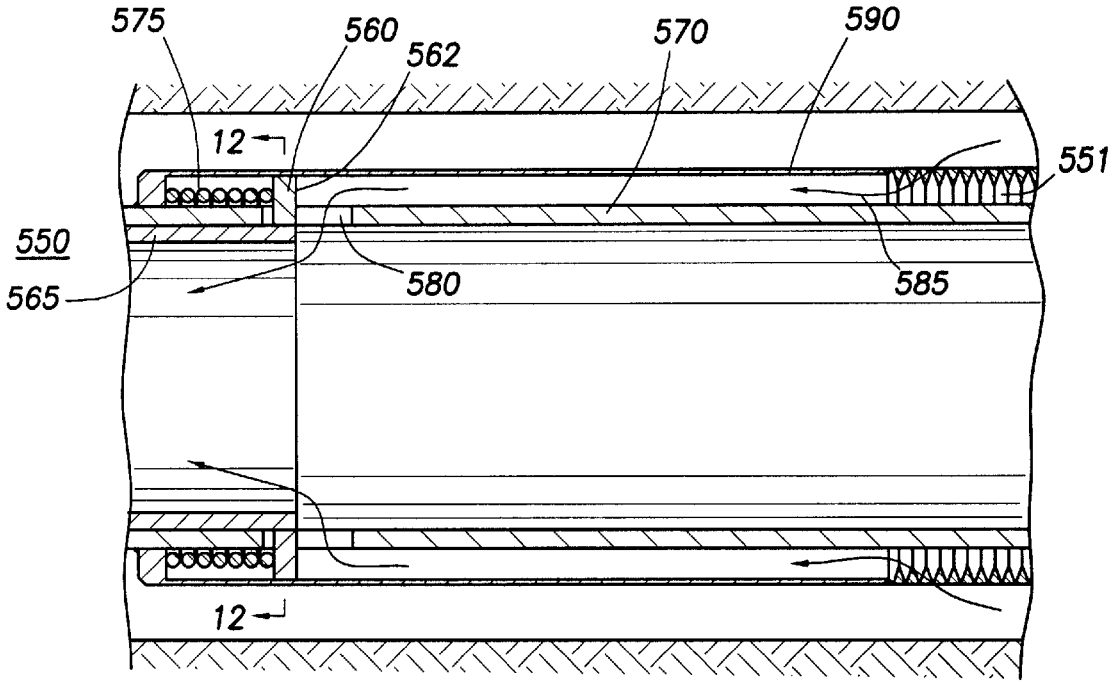
FIG. 10 is an alliterative embodiment of the invention and FIG. 11 is another view of the embodiment of FIG. 10.
Figure 11:
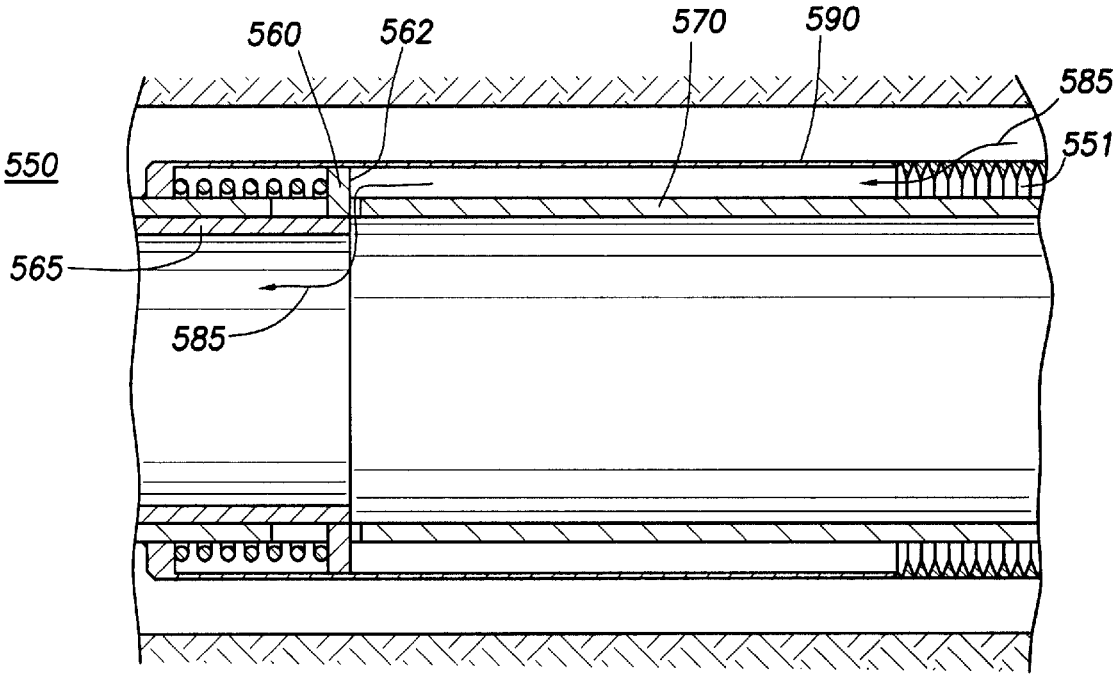
Figure 12:
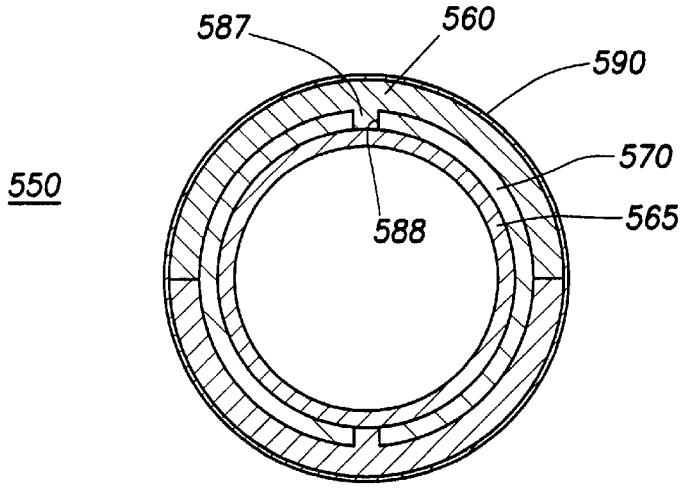
FIG. 12 is an end view, in section of the embodiment of FIG. 10 taken through a line 12—12 of FIG. 10.

FIGS. 10, 11 and 12 illustrate an alternative embodiment of a flow control apparatus 550. FIG. 10 illustrates the apparatus 550 in an open position whereby fluid, shown by arrows 585 enters the apparatus through screen portion 551 and flows through an annular area formed between an outer housing 590 and tubular member 570. Thereafter, the fluid flows into the device through an aperture 580 formed in tubular member 570. Control of fluid flow is determined by the position of an annular piston 560 which is affixed to an inner sleeve 565. The annular piston 560 and inner sleeve 565 move together to selectively expose and cover aperture 580. Annular piston 560 includes a piston surface 562 which is acted upon by the fluid flowing through the apparatus and actuates the annular piston and inner sleeve 565 against a spring 575 disposed opposite piston surface 562.

FIG. 12 is a section view taken along lines 12—12 of FIG. 10 and further illustrates the relationship of the components of the apparatus 550. Visible specifically in FIG. 12 is outer housing 590 with annular piston 560 disposed therein. Annular piston 560 includes inwardly directed tab portions 587 which are housed in a slots 588 formed in tubular member 570. As the annular piston 560 and inner sleeve 565 move axially in relation to mass fluid velocity on the piston surface 562, the piston and inner sleeve move within the slot 588. FIG. 11 illustrates the apparatus 550 of FIG. 10 in a closed or choked position. In FIG. 11, spring member 575 is extended and has urged the annular piston 560 and inner sleeve 565 in a direction against the flow of fluid, thereby partially closing aperture 580 to the flow of fluid therethrough.

Figure 13:
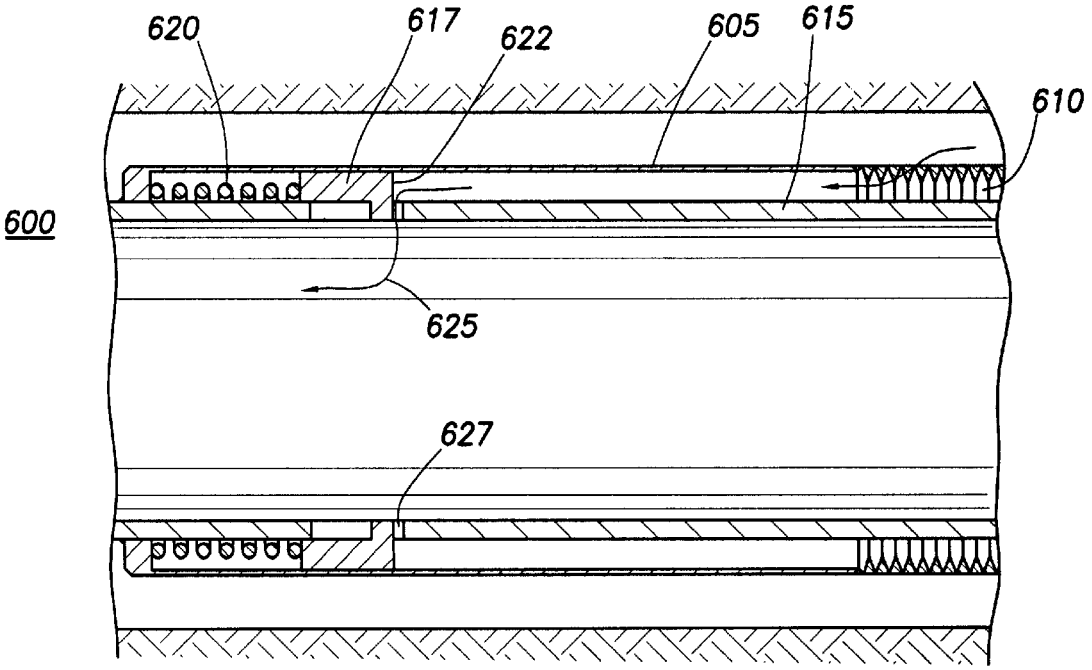
FIG. 13 is a section view showing an alliterative embodiment of the invention.

FIG. 13 illustrates an alternative embodiment of a flow control apparatus 600 for use in a wellbore comprising an annular piston 617 having a downwardly extending piston surface 622 formed at a first end thereof. Fluid enters the flow control apparatus 600 through a screen portion 610 and flows through an annular area created between the outer surface of tubular member 615 and housing 605. Apertures 627 formed in tubular member 615 provide access to the interior of device 600. Piston 617 is slidably mounted and operates against spring 620 to alternatively expose and cover aperture 627. The apparatus 600 is constructed and arranged whereby mass fluid velocity acting upon piston surface 622 deflects the piston against spring 620, thereby exposing a greater amount of aperture 627 to the flow of fluid illustrated by arrow 625.

Figure 14:
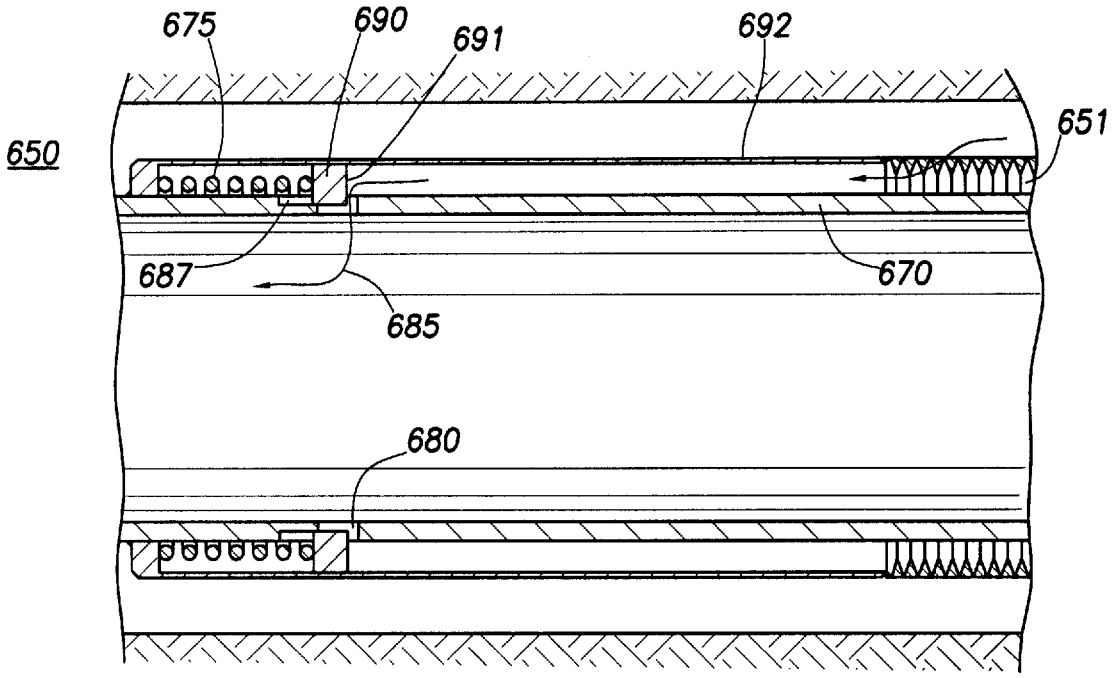
FIG. 14 is a section view showing an alternative embodiment of the invention.

FIG. 14 is an alternative embodiment of a flow control apparatus 650 including an annular piston 690 which operates to selectively expose an aperture 680 by moving axially in a slot 687 against a spring member 675. In this embodiment, fluid enters the apparatus 650 through screen portion 651 and travels through an annular area created between tubular member 670 and outer housing 692. Thereafter, the fluid flows into the interior of the apparatus 650 through an aperture 680 formed in tubular member 670. The path of fluid flow is illustrated by arrow 685. Annular piston 690 includes a piston surface 691 which is acted upon by mass fluid velocity and permits the piston to move against spring member 675 to expose a greater portion of aperture 680 to the flow of fluid 685.

Figure 15:
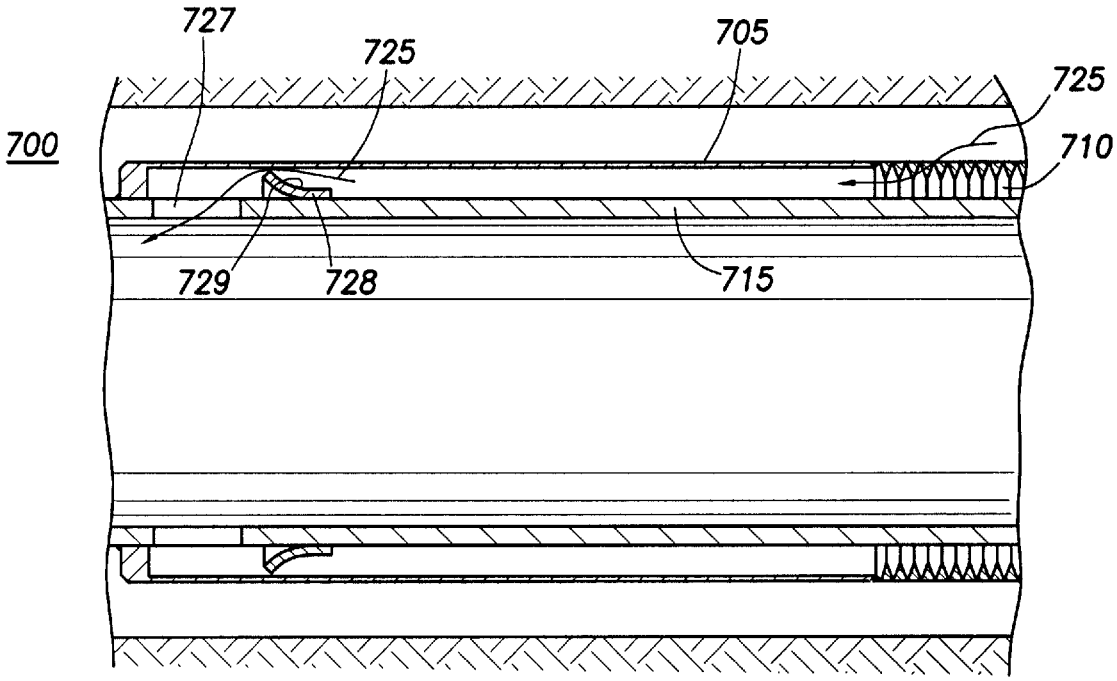
FIG. 15 is a section view showing an alternative embodiment of the invention.

FIG. 15 is an alternative embodiment of a flow control apparatus 700 including a plurality of flexible leaf members 728 constructed and arranged to become depressed when exposed to a predetermined mass fluid velocity, thereby permitting fluid to flow into the interior of apparatus 700. Fluid enters the apparatus through screen portion 710 and continues in an annular area formed between tubular member 715 and housing 705. Thereafter, the fluid encounters at least one flexible leaf member 728 with surface 729 formed thereupon. At plurality of flexible leaf member 728, as one flexible member extending around the annular area are selected and arranged whereby a predetermined amount of mass fluid flow rate will depress the flexible leaves permitting fluid flow (illustrated by arrow 725 to enter the interior of the apparatus 700 through apertures 727 formed in tubular member 715).

Figure 16:
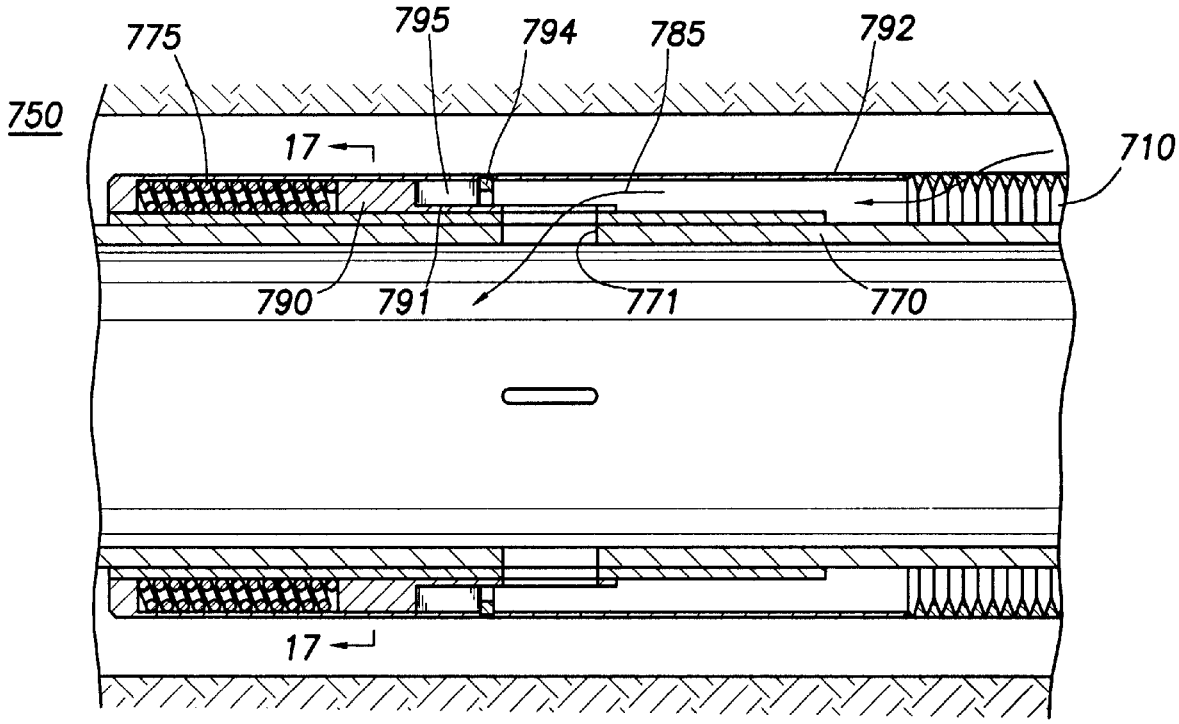
FIG. 16 is a section view showing an alternative embodiment of the invention and FIG. 17 is an end view in section thereof taken along a line 17—17 of FIG. 16.
Figure 17:
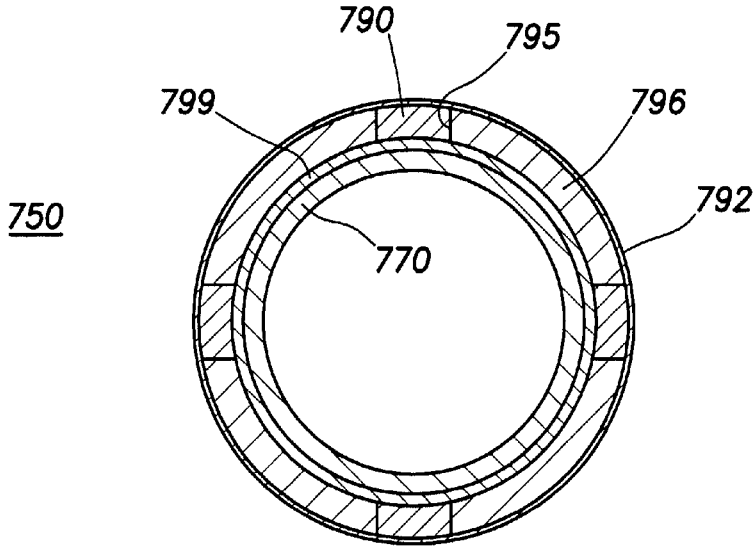

FIG. 16 is an alternative embodiment of an apparatus 750 of the invention including a plurality of piston segments which move independently in relation to a perforated tubular member. FIG. 17 is a cross-sectional view of the embodiment of FIG. 16 taken along line 17—17 of FIG. 16. The apparatus 750 includes a screen portion 16 where fluid enters and travels in an annular area formed between the outside of a tubular member 770 and a housing 792 therearound. The flow of fluid through and into the apparatus 750 is depicted by arrow 785. Considering FIGS. 16 and 17 in greater detail, the apparatus 750 includes pistons 790 which move axially within slots 795 which are formed in a ring 796. Each piston 790 includes a sleeve portion which is integrally formed thereon and is movable with the piston to cover and expose apertures 771 formed in tubular member 770. At a second end, the piston acts against a spring member 775.

The apparatus 750 is designed whereby piston 790 is urged against spring 775 by a mass flow velocity of fluid travelling through the apparatus 750. As the piston is deflected against the spring, the sleeve portion 791 of the piston uncovers aperture 771 and fluid in the annular area between the tubular member 750 and housing 792 travels into the interior of the apparatus 750. In the absence of a sufficient mass fluid velocity the spring urges the piston against a stop ring 794 formed around the interior surface of housing 792. In the embodiment shown in FIG. 16, when the piston is fully urged against stop ring 794, the integral sleeve portion of the piston completely covers apertures 771 thereby preventing fluid flow into the apparatus 750. Visible specifically in FIG. 17 is the housing 792 of the apparatus 750 disposed around a ring 796 having slots 795 formed therein. A sleeve portion 799 is disposed therein around a tubular member 770. In the embodiment illustrated in FIG. 17, the piston 790 is disposed around the perimeter of the apparatus and each piston is equipped with a separate spring member 775 and moves independently according to the mass fluid velocity at that location in the apparatus.

While the foregoing is directed to the preferred embodiment of the present invention, other and further embodiments of the invention may be devised without departing from the basic scope thereof, and the scope thereof is determined by the claims that follow.

What is claimed is:

1. A flow control device for use in a wellbore comprising:

an inner member having at least one aperture formed therein;

at least one axially movable member disposed radially outwards of the inner member to selectively cover the at least one aperture of the inner member, the movable member having a piston surface formed thereupon;

a biasing member disposed adjacent the movable member and opposing axial movement of the movable member; and an outer casing disposed radially outward of the movable member.

2. The flow control device of claim 1, wherein the axially movable member is a sleeve having at least one aperture formed therethrough.

3. The flow control device of claim 2, wherein at least one aperture of the inner member is aligned with at least one aperture of the sleeve when the sleeve is in a first position relative to the inner member and at least one aperture of the inner member is misaligned with at least one aperture of the sleeve when the sleeve is in a second position relative to the inner member.

4. The flow control device of claim 2, wherein the device is disposed in a horizontal wellbore adjacent a heel portion of the horizontal wellbore.

5. The flow control device of claim 2, wherein a plurality of the devices are disposed in a wellbore having an oil bearing formation therearound.

6. The flow control device of claim 2, wherein the device includes a screened portion extending from a first end thereof, the screened portion directing fluid into the device.

7. The flow control device of claim 2, wherein the device further includes an attachment assembly for attachment to a screened tubular, the attachment assembly including:

exterior threads formed at a first end of the device;

a coupling ring to fasten the exterior threads with exterior threads of the screened tubular; and a stab portion extending from the first end of the device, the stab portion insertable into the interior of the screened tubular to form an annular area between the exterior of the stab portion and the interior of the screened tubular, the annular area forming a path for fluid flow into the device.

8. The flow control device of claim 2, further comprising a solenoid member mechanically connected to the sleeve, whereby the solenoid member can cause the sleeve to move axially in relation to the inner member.

9. The flow control device of claim 8, further including at least one pressure sensor for sensing a pressure value and communicating the pressure value to the solenoid.

10. The flow control device of claim 3, wherein in the second position, the flow of fluid into the device is restricted by the misalignment of the apertures of the sleeve and the apertures of the inner member.

11. The flow control device of claim 10, wherein the sleeve can assume any number of positions between the first and second position, each of the any number of positions creating a different amount of misalignment between the apertures of the sleeve and the apertures of the inner member.

12. The flow control device of claim 11, wherein the apertures are substantially misaligned in a first and second positions but are substantially aligned in a central position.

13. The flow control device of claim 10, wherein the device restricts the flow of fluid in a first and second position but permits the unrestricted flow of fluid in a center position.

14. The flow control device of claim 10, wherein the device permits the unrestricted flow of fluid in a first and second position but restricts the flow of fluid in a center position.

15. The flow control device of claim 10 further comprising a piston surface formed on the sleeve opposite the biasing member, the piston surface constructed and arranged to be acted upon by the fluid flow into the flow control device.

16. The flow control device of claim 15, wherein the position of the sleeve is determined at least in part by the mass flow rate of the fluid flowing into the flow control device.

17. The flow control device of claim 15, wherein the position of the sleeve is determined at least in part by a difference in fluid pressure between the fluid outside of the device and the fluid inside of the device.

18. The flow control device of claim 15, wherein the device includes a connection member for a hydraulic control line to place hydraulic fluid in communication with the piston surface of the sleeve.

19. The flow control device of claim 18, wherein the hydraulic fluid provides additional biasing to oppose axial movement of the sleeve.

20. A method of controlling the fluid flow into a hydrocarbon producing wellbore comprising:

inserting a flow control apparatus into the wellbore adjacent a fluid bearing formation such that the fluid in the formation is in communication with an outer surface of the apparatus;

causing the fluid to act upon a piston surface formed on an axial movable sleeve in the apparatus; and causing the sleeve to shift in reaction to a predetermined mass flow rate of fluid, thereby misaligning apertures formed in the sleeve with apertures formed in an inner member of the apparatus.

21. The method of claim 20, further including changing the mass flow rate of fluid by changing the amount of gas injected into the formation from an adjacent gas injection well.

22. A flow control device for use in a wellbore comprising:

an inner member having at least one aperture therethrough;

an outer body disposed around the inner member with an annular area formed therebetween;

a flexible, flow restriction member disposed in the annular area, the flow restriction member constructed and arranged to deform and reform to permit a variable flow of a fluid to pass through the annular area and into at least one aperture.

* * * * *

UNITED STATES PATENT AND TRADEMARK OFFICE
Certificate

Patent No. 6,371,210 B1 Patented: April 16, 2002

On petition requesting issuance of a certificate for correction of inventorship pursuant to 35 U.S.C. 256, it has been found that the above identified patent, through error and without any deceptive intent, improperly sets forth the inventorship.

Accordingly, it is hereby certified that the correct inventorship of this patent is: Jeffrey Bode, The Woodlands, Texas; Eric Lauritzen, Kingwood, Texas; and John Cameron, The Woodlands, Texas.

Signed and Sealed this Fifth Day of October 2004.

DAVID J. BAGNELL
*Supervisory Patent Examiner*
Art Unit 3672